United States Patent [19]

Stursberg et al.

[11] Patent Number: 4,945,752

[45] Date of Patent: Aug. 7, 1990

[54] TOOL CARRIER FOR A PUNCH OR STAMPING MACHINE

[75] Inventors: Bernd Stursberg; Karl-Heinz Bauer, both of Ennepetal, Fed. Rep. of Germany

[73] Assignee: Rolf Peddinghaus, Ennepetal, Fed. Rep. of Germany

[21] Appl. No.: 316,756

[22] Filed: Feb. 28, 1989

[30] Foreign Application Priority Data

Mar. 4, 1988 [DE] Fed. Rep. of Germany ..... 3807075

[51] Int. Cl.[5] ..... B21D 37/02

[52] U.S. Cl. ..... 72/442; 72/404; 72/462; 72/472; 72/481; 83/561

[58] Field of Search ..... 72/442, 404, 472, 462, 72/481, 389, 452, 444, 446; 83/561

[56] References Cited

U.S. PATENT DOCUMENTS

| | | | |
|---|---|---|---|
| 3,844,157 | 10/1974 | Bachmann | 72/452 |
| 4,160,372 | 7/1979 | Bergman et al. | 72/404 |
| 4,347,727 | 9/1982 | Galiger | 72/452 |
| 4,445,357 | 5/1984 | Powers et al. | 72/404 |
| 4,509,357 | 4/1985 | Zbornik | 72/442 |
| 4,510,789 | 4/1985 | Tomioka et al. | 72/461 |
| 4,535,689 | 8/1985 | Putkowski | 72/452 |
| 4,550,588 | 11/1985 | Abe et al. | 72/472 |
| 4,581,818 | 4/1986 | Kondou et al. | 72/472 |
| 4,676,090 | 6/1987 | Nishimura et al. | 72/446 |
| 4,733,552 | 3/1988 | Lefils | 72/472 |
| 4,791,803 | 12/1988 | Broquet et al. | 72/472 |

FOREIGN PATENT DOCUMENTS

| | | | |
|---|---|---|---|
| 8624193.1 | 8/1986 | Fed. Rep. of Germany . | |
| 0137823 | 3/1955 | Japan | 72/442 |

*Primary Examiner*—David Jones

*Attorney, Agent, or Firm*—Herbert Dubno; Ronald Lianides

[57] ABSTRACT

A tool carrier for a punch or stamping machine in which the positioning piston-and-cylinder devices for respective actuating elements are disposed with a fixed center-to-center spacing from one another on opposite sides of a plane of symmetry and the tool holders are disposed in the tool carrier with their tools located symmetrically with respect to this plane so that individual tools can be operatively enabled by single actuating elements, larger tools by pairs of such actuating elements and even larger tools by two pairs of such actuating elements in symmetrical relationship.

7 Claims, 3 Drawing Sheets

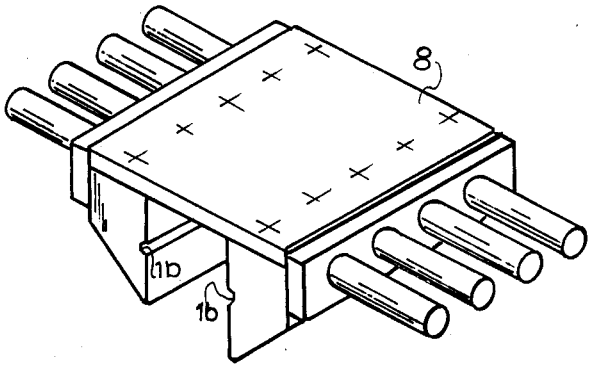
FIG.5
FIG.6
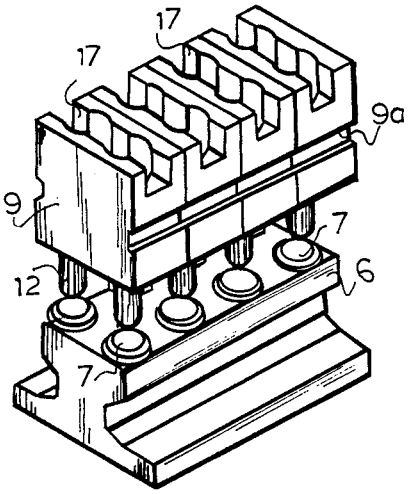
FIG.7
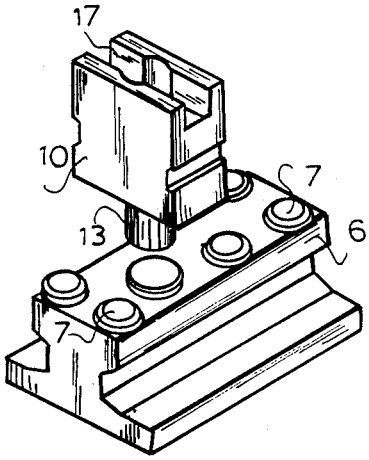
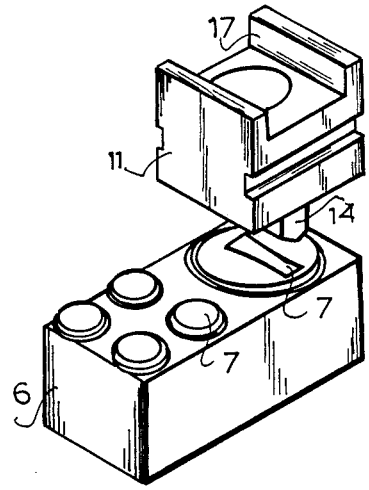
FIG.8

TOOL CARRIER FOR A PUNCH OR STAMPING MACHINE

FIELD OF THE INVENTION

Our present invention relates to a tool carrier for a punch or stamping machine and, more particularly, to a punch or stamper carrier adapted to be mounted in a machine frame, to carry the punching or stamping tools which are displaceable relative to an anvil or die to punch or stamp a workpiece, and which can be provided with actuators for operatively enabling the displacing these tools in the working direction, i.e. in a direction toward and away from the die and, generally, in a vertical direction.

BACKGROUND OF THE INVENTION

German Utility Model 86 24 193 describes a tool carrier for a punching or stamping press, hereinafter referred to as a punch or as a stamping machine, which has a tool carrier upper part formed with a downwardly open recess, a plurality of punch tool holders receivable in the recess and respective punch tools movable in an up-and-down manner in the holders.

Activating or actuating elements are provided for the tools and positioning piston-and-cylinder arrangements are provided for locating the actuating elements in position so that, upon operation of the press, the actuating elements will enable the driving the tools in the working direction, i.e. in the up and down direction.

Generally speaking, the tool holders can be inserted into the tool carrier upper part and the tool carrier upper part can have guides for the actuating element while the positioning piston-and-cylinder devices are affixed to the tool carrier upper part.

The term "tool holder" generally refers to a basically rectangular body which is provided with means for fixing it in the tool carrier upper part or, stated otherwise, as formations matching that of the tool carrier upper part for interfitting of the two. Such formations can include, for example, registering grooves of the tool holder and the tool carrier upper part into which a bar or rod can be fitted.

In the tool carrier of German Utility Model 86 24 193, the positioning cylinder devices are disposed on only one side of the tool carrier upper part. These devices move the actuating elements across the total width of the carrier and, of course, across the tool holders which are arrayed in the direction of the positioning piston displacement.

The tool holders are each associated with a positioning cylinder arrangement and each can receive only a single tool.

This requires that the set-up of the tools be effected in consideration of the punching force and greatly limits the geometry or area of the punching action. Stated otherwise, large-diameter punches cannot be accommodated and the shapes which may be punched are limited by the geometry of the holders.

The versatility of the system is poor since, for the punching or stamping of large-area articles, one must use larger presses and, conversely, it is not possible within the limits of the tool carrier and the conventional tool-holder design to produce a multiplicity of different types, sizes or shapes of punched articles with the desired degree of freedom of choice.

OBJECTS OF THE INVENTION

It is, therefore, the principal object of the present invention to provide an improved tool carrier for a punch press or stamping machine which is free from the aforedescribed drawbacks.

Another object of the invention is to provide a tool carrier for the purposes described which has greater versatility than the tool carriers provided heretofore.

Yet another object of our invention is to provide a tool carrier of the basic shape used heretofore but which can accommodate a variety of different punching or stamping tools respectively operating with greatly different punching or stamping forces in a highly versatile manner.

SUMMARY OF THE INVENTION

These objects and others which will become apparent hereinafter are attained, in accordance with the invention in a tool carrier for the purposes described which comprises:

a tool carrier body having a recess opening in a direction of a workpiece to be stamped or punched;

a plurality of tool holders interchangeably and replaceably received in the body, each of the tool holders being formed with at least one guide;

respective punching or stamping tools received in the guides and displaceable therein toward and away from the workpiece;

a multiplicity of tool-actuating elements receivable in the body, positionable so that at least one of the tool-actuating elements is in juxtaposition with each of the tools, and operable to enable the displacement of the respective tool in the respective guide; and a respective positioning piston-and-cylinder device acting upon each of the tool-actuating elements for positioning same in juxtaposition with the respective tool, the positioning piston-and-cylinder devices being mutually parallel, the positioning piston-and-cylinder devices and the tool-actuating elements being spaced apart with a constant center-to-center spacing (a) on opposite sides of a line of symmetry (S) between pairs of the devices and elements and extending orthogonal to directions of displacement of the devices, the tool holders being formed so that the guides of a multiplicity of the holders are spaced in the direction of the line of symmetry with a center-to-center spacing n(a/2), whereby at least one of the elements is juxtaposed with each tool and for any of the tools centered on the line of symmetry at least one pair of the elements symmetrically bear on the respective tool, n being an integer preferably between 2 and 4.

Advantageously, the holders can be provided to accommodate two small-area tools each of which can be juxtaposed with a respective one of the actuating elements of a single pair of piston-and-cylinder devices or a single punch of larger area than the individual punches and which is juxtaposed with two such actuating elements of a single pair, or a punch of still larger diameter or area which is juxtaposed with the four actuating elements of two of these pairs.

The positioning piston-and-cylinder devices are located with equal spacing on both sides of the median plane for this purpose and are provided in pairs.

The tool carrier permits holders containing a variety of different tools to be utilized, the tools also requiring greatly differing punching forces, while the system nevertheless is a rapid-change system for the tools since the respective holders can be inserted or removed with ease and because of the modular construction of these holders will always have the tool line up with the one, two or four actuating elements as described.

BRIEF DESCRIPTION OF THE DRAWINGS

The above and other objects, features and advantages of the present invention will become more readily apparent from the following description, reference being made to the accompanying drawing in which:

FIG. 5 is a perspective view of the tool carrier upper part from which the holders have been removed; and FIGS. 6–8 are perspective views showing the various holders which can be used and illustrating the punching or stamping die with which the tools cooperate.

Specific Description

Figure 3:
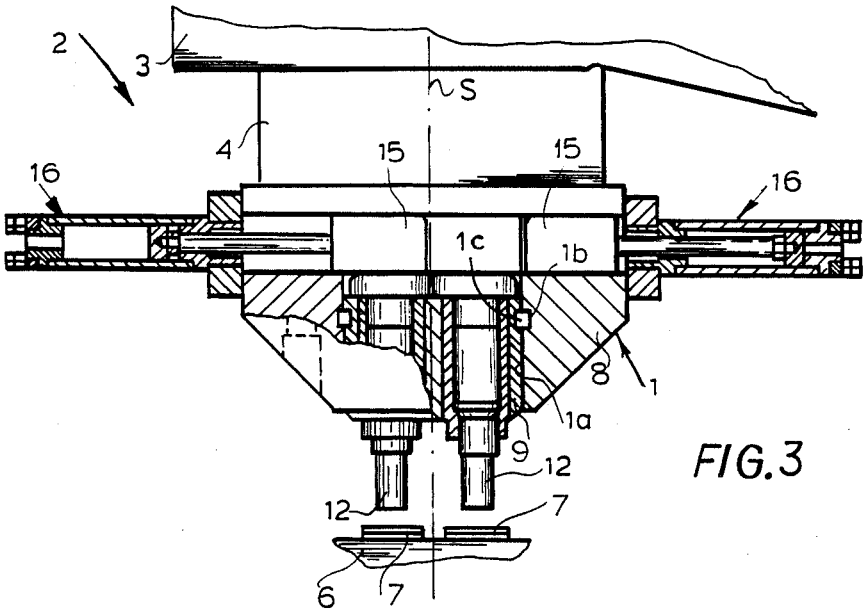
FIG. 3 is a front-elevational view, partly broken away and taken in the direction of the arrow III of FIG. 1.

In FIG. 3 of the drawing, the tool carrier 1 for the punching or stamping machine 2 is shown to be formed with a downwardly open recess 1*a* having a pair of grooves 1*b* into which a key or bar 1*c* can be inserted to lock into corresponding grooves 9*a* of modular tool holders 9, for example.

Figure 2:
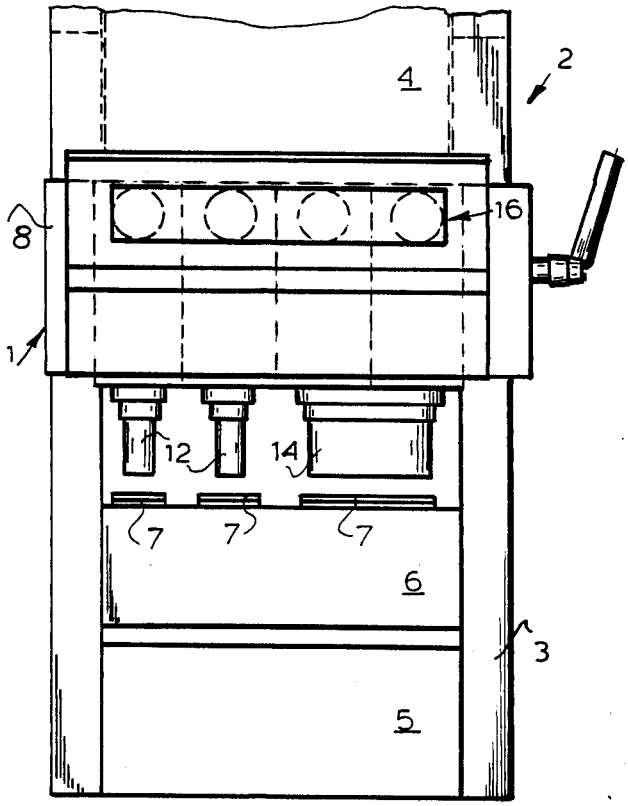
FIG. 2 is a side elevational view taken in the direction of the arrow II of FIG. 1.

In FIGS. 2 and 3, we have also shown some parts of the machine 2, namely, the machine frame 3, the tool carriage 4 and the table 5 upon which die carrier 6 provided with the dies 7 can be mounted.

Figure 1:
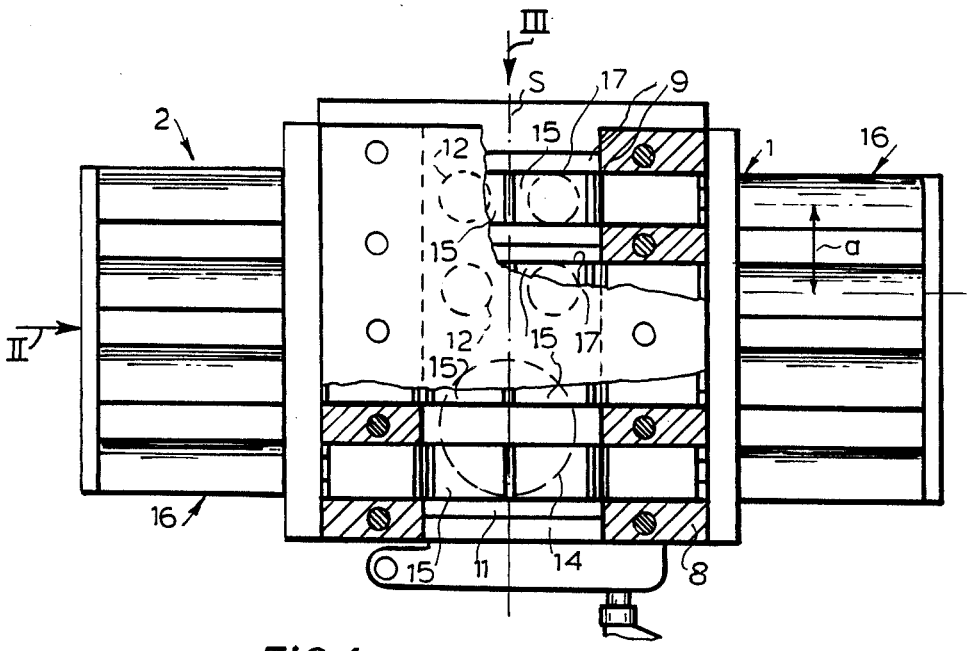
FIG. 1 is a top-plan view partially broken away of a tool carrier according to the invention.

Referring to FIGS. 1, 3 and 5, it will be apparent that tool carrier 1 comprises the tool carrier upper part 8 formed with the grooves 1*b* previously mentioned, a plurality of punching tool holders 9, 10, 11 of identical outer configuration and receiving respective punching tools 12, 13 and 14 which are movable vertically in the respective tool holder, i.e. in an up-and-down direction.

The carrier also is equipped with horizontally sliding actuating elements 15 for enabling operation of these tools 12, 13 and 14 and with positioning piston-and-cylinder devices 16 for displacing these actuating elements 15 (see the aforementioned German Utility Model).

As noted previously, moreover, the holders 9, 10 and 11 are replaceably and interchangeably fitted into the recess 1*a* and held in place by the bars 1*c* as will be apparent from FIGS. 1–3.

The holders 9, 10 and 11 at the upper part 8 of the carrier 1 are formed with guides 17 for receiving the actuating elements 15. The positioning piston-and-cylinder devices 16 are affixed to the tool carrier upper part 8.

Figure 4:
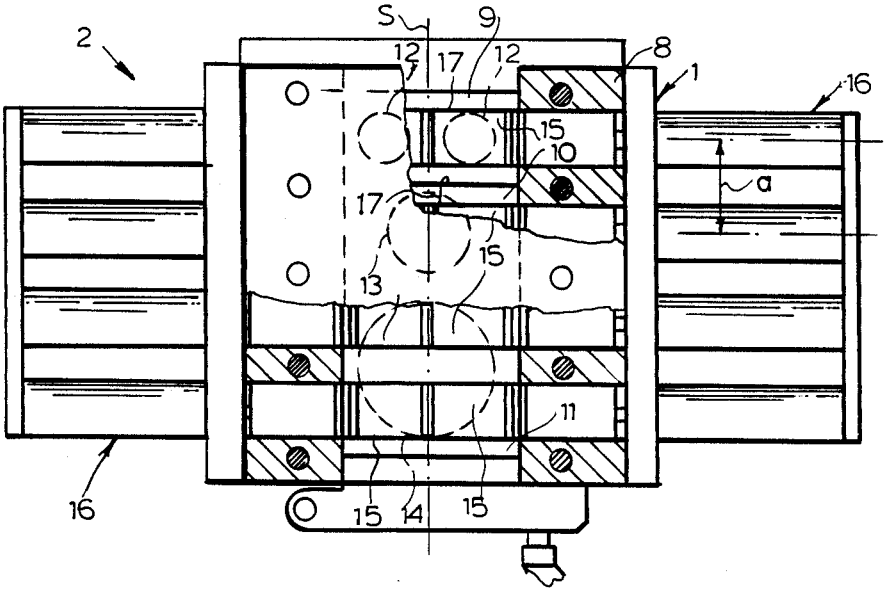
FIG. 4 is a view similar to FIG. 1 illustrating a different assembly of tool holders in the carrier.

From FIGS. 1 and 4, it will be apparent that the piston-and-cylinder devices 16 and the mutually identical actuating elements 15 are arranged in a grid pattern or array with a constant spacing from one another, namely a center-line spacing a and are disposed to opposite sides of line of symmetry S. s The symmetry line S runs orthogonal to the displacement direction of the positioning piston-and-cylinder devices 16.

As is apparent from FIG. 6–8 and can be deduced as well from FIGS. 1, 2 and 4, the tool holders include stamping tool holders 9 which like the holders 10 and 11 are of modular construction with length, horizontally arranged in any number in the tool carrier upper part B and in any assortment of the three types of holders, will have the respective punches symmetrically positioned relative to the actuating elements 15.

For example, when two holders 9 are provided, the center-to-center spacing of the punches 12 of one from the punches 12 of the other is equal to the spacing a and the two punches 12 of each of these holders are disposed symmetrically with respect to the line of symmetry S previously described (see especially FIGS. 1 and 6).

The holder 13 has its single tool 10 (see FIGS. 4 and 7) spaced from the center line of the holder 9 and its tools 12 by the distances a as well, and is centered on the plane of symmetry S (FIG. 4) so that two actuating elements 15 of a common pair of devices 16 will be disposed symmetrically in alignment or juxtaposition with this tool.

Finally, the holders 11 can be provided with tools or punches 14 whose center-to-center spacing from that of the punch 13 or a pair of punches 12 is some other integral multiple of the distance a/2, i.e. is n·a/2 where n is an integer preferably 1, 2, 3 or 4. The tool 14 is likewise disposed symmetrically to the symmetry plane S and can be overlapped by four actuating elements 15 (see FIGS. 1 and 8).

FIGS. 1 and 4, therefore, show that the operation of the punch tool 14 is enabled by four actuating elements 15 and thus since it is larger with substantially four times the force delivered to each of the individual tools 12. In a single tool carrier of the type shown in FIG. 4, for example, operation of the individual tools 12 is enabled with the comparatively smaller force requiring only individual actuating elements 15, while the larger tool 10 is operated with substantially twice this force requiring the combination of two symmetrically disposed actuating elements whereas the tool 14 is operated with a force of substantially four times that applied to the individual tools 12.

If, for example, each of the tools in FIG. 6 receives an operating force of 25 metric tons, the tool 13 shown in FIG. 7 will receive a stamping force of 50 tons while the tool 14 in FIG. 8 will receive a force of 100 tons.

The pressure per unit area of the machine is, however, the same regardless of the fact that different tools with different punching forces are used since the stamping force is enabled only in relation to with the number of actuating elements 15 which are shifted into position in a tool holder.

We claim:

1. A tool carrier assembly for a punching or stamping machine, said tool carrier comprising;

a tool carrier body having a recess opening in a direction of at least one die;

a plurality of tool holders interchangeably and replaceably received in said recess of said body, each of said tool holders being formed with at least one guide;

respective punching or stamping tools received in said guides and displaceable therein toward and away from said at least one die;

a multiplicity of tool-actuating elements receivable in said body and positionable so that at least one of said tool-actuating elements is in juxtaposition with each of said tools, and operable to enable the displacement of the respective tool in the respective guide; and a respective positioning piston-and-cylinder device acting upon each of said tool-actuating elements for positioning same in juxtaposition with the respective tool, said positioning piston-and-cylinder devices being mutually parallel, said positioning piston-and-cylinder devices and the tool-actuating elements being spaced apart with a constant center-to-center spacing a on opposite sides of a line of symmetry S between pair of said devices and elements and extending orthogonal to directions of displacement of said devices, said tool holders being formed so that the guides of a multiplicity of said holders are spaced in the direction of said line of symmetry with a center-to-center spacing n(a/2), whereby at least one of said elements is juxtaposed with each tool and for any of said tools centered on said lien of symmetry at least one pair of said elements symmetrically bear on the respective tool.

2. The tool carrier assembly defined in claim 1 wherein said holders include at least one holder receiving a tool centered on said line of symmetry and having two of said elements of a respective pair thereof acting thereon.

3. The tool carrier assembly defined in claim 2 wherein said holders include at least one holder receiving a tool centered on said line of symmetry and having four of said elements of two respective pairs thereof acting thereon.

4. The tool carrier assembly defined in claim 1 wherein said holders include at least one holder receiving a tool centered on said line of symmetry and having four of said elements of two respective pairs thereof acting thereon.

5. The tool carrier assembly defined in claim 1 wherein said holders include at least one holder receiving a pair of tools symmetrically equidistant from said line of symmetry and having respective one of said elements of a respective pair thereof acting thereon.

6. The tool carrier assembly defined in claim 5 wherein said holders include at least one holder receiving a tool centered on said line of symmetry and having two of said elements of a respective pair thereof acting thereon.

7. The tool carrier assembly defined in claim 6 wherein said holders include at least one holder receiving a tool centered on said line of symmetry and having four of said elements of two respective pairs thereof acting thereon.

* * * * *